US008562234B2

(12) United States Patent
Lim

(10) Patent No.: US 8,562,234 B2
(45) Date of Patent: Oct. 22, 2013

(54) PUFF MANUFACTURING METHOD AND PUFF MANUFACTURED THEREBY

(75) Inventor: Seong Wook Lim, Seoul (KR)

(73) Assignee: Daehyun Industrial Arts Co., Ltd, Seoul (KR)

( * ) Notice: Subject to any disclaimer, the term of this patent is extended or adjusted under 35 U.S.C. 154(b) by 0 days.

(21) Appl. No.: 13/878,264

(22) PCT Filed: Oct. 26, 2011

(86) PCT No.: PCT/KR2011/008041

§ 371 (c)(1),
(2), (4) Date: Apr. 8, 2013

(87) PCT Pub. No.: WO2012/173309

PCT Pub. Date: Dec. 20, 2012

(65) Prior Publication Data

US 2013/0236231 A1 Sep. 12, 2013

(30) Foreign Application Priority Data

Jun. 13, 2011 (KR) ..... 10-2011-0056871
Oct. 21, 2011 (KR) ..... 10-2011-0108190

(51) Int. Cl.

| | |
|---|---|
| ***A45D 33/00*** | (2006.01) |
| ***A45D 33/02*** | (2006.01) |
| ***A45D 33/34*** | (2006.01) |
| ***B05C 19/00*** | (2006.01) |
| ***B05C 19/04*** | (2006.01) |

(52) U.S. Cl.
USPC ..... 401/200; 15/229.14; 132/293

(58) Field of Classification Search
USPC ..... 401/200; 15/229.14
See application file for complete search history.

(56) References Cited

U.S. PATENT DOCUMENTS

| | | | | | |
|---|---|---|---|---|---|
| 2,009,794 | A * | 7/1935 | Winsor | ..... | 401/200 |
| 2,237,847 | A * | 4/1941 | Smith | ..... | 401/34 |
| 2,664,226 | A * | 12/1953 | Gobin | ..... | 222/632 |
| 2,919,703 | A * | 1/1960 | Pinteau | ..... | 401/119 |
| 6,009,885 | A * | 1/2000 | Nam | ..... | 132/293 |
| 2003/0072602 | A1* | 4/2003 | Gueret | ..... | 401/261 |
| 2010/0319723 | A1* | 12/2010 | Parker | ..... | 132/287 |
| 2011/0048443 | A1* | 3/2011 | Pires et al. | ..... | 132/200 |
| 2012/0125361 | A1* | 5/2012 | Yeom | ..... | 132/293 |

FOREIGN PATENT DOCUMENTS

| | | |
|---|---|---|
| JP | 2004-208775 | 7/2004 |
| JP | 2006-263432 | 10/2006 |

OTHER PUBLICATIONS

International Search Report mailed May 11, 2012 for PCT/KR2011/008041.
Written Opinion of the International Search Report mailed May 11, 2012 for PCT/KR2011/008041.
Korean Office Action dated Apr. 2, 2012 corresponding to Korean Patent Application No. 10-2011-0108190.

* cited by examiner

*Primary Examiner* — David Walczak
*Assistant Examiner* — Joshua Wiljanen

(57) ABSTRACT

Disclosed are a method for manufacturing method a puff and the puff manufactured thereby. The method for manufacturing a puff comprises steps of: a) making a perforated cloth by perforating and cutting a puff cloth using a laser perforation apparatus; b) making a puff base by molding the perforated cloth; c) manufacturing a solid powder which includes a porous material which was inserted into a powder and compressed together with same; d) inserting the solid powder into the puff base; and e) manufacturing a puff by covering by sewing the puff cover onto the puff base.

20 Claims, 8 Drawing Sheets

PUFF MANUFACTURING METHOD AND PUFF MANUFACTURED THEREBY

TECHNICAL FIELD

The present invention relates to a manufacturing method of puff and a puff fabricated by the same, and more particularly, to a method for manufacturing puff for applying cosmetic material, and a puff fabricated by the same which is portable and convenient to use.

This application claims the priority of Korean Patent Application Nos. 10-2011-0056871 and 10-2011-0108190, filed on Jun. 13, 2011 and Oct. 21, 2011 in the KIPO (Korean Intellectual Property Office), the disclosure of which is incorporated herein entirely by reference. Further, this application is the National Stage application of International Application No. PCT/KR2011/008041, filed Oct. 26, 2011, which designates the United States and was published in Korean. Each of these applications is hereby incorporated by reference in their entirety into the present application.

BACKGROUND ART

Generally, puff is used for applying cosmetic material such as powder, cake powder, or twin cake powder onto facial area of a human. Such puff consists of a puff body and a handle.

Cosmetic powder is generally separately received in a powder casing which is usually carried around by a user. For use, the user loads the puff with powder and then applies the powder.

The puff body is mainly provided in a sponge form made from material such as urethane, flocking, polyvinyl alcohol (PVA), or rubber, and manufactured mainly by the steps of cutting out the puff body and ribbon to predetermined sizes, respectively, and sewing both ends of the ribbon to the puff body.

However, since users of these conventional puffs generally have to carry around both the puff and the puff casing where the powder is held for occasional application of the powder, use thereof is inconvenient. Further, for the manufacturer's part, it is disadvantageous because the manufacturer has to construct separate manufacturing lines to fabricate puffs and powder casings, respectively.

DISCLOSURE OF THE INVENTION

Technical Problem

The invention has been made to overcome the above-mentioned problems occurring in the prior art, and accordingly, it is an object of the present invention to provide a method of manufacturing puffs which are portable and easy to use.

Further, it is another object of the invention to provide a puff manufactured by said manufacturing method.

Technical Solution

In one embodiment, a method of manufacturing a puff may include a) laser-perforating a puff fabric using a laser perforating device and cutting out said puff fabric to prepare a perforated fabric, b) fabricating a puff base by shaping the perforated fabric, c) preparing a compact powder containing a porous member therein, by compressing powder in powder form with the porous member inserted therein, d) inserting the compact powder into the puff base, and e) fabricating a puff by covering the puff base which includes sewing the puff cover onto the puff base.

The preparing step c) may include c1) first introducing the powder in powder form into a mold, c2) seating the porous member on the first-introduced powder, in which the porous member having a number of pores ranging between 35 ppi and 45 ppi, c3) second-introducing the powder in powder form, and c4) compressing the powder in powder form and the porous member introduced into the mold with pressure ranging between 15 kg/cm2 and 25 kg/cm2 with a compression device.

The manufacturing method may additionally include f) supplement-inserting the powder in powder form into an interior space of the puff.

In one embodiment, a method of manufacturing a puff may be provided, which may include a) laser-perforating a puff fabric using a laser perforating device and cutting out to prepare a perforated fabric, b) fabricating a puff base by shaping the perforated fabric, c) finishing an exterior of the puff by covering which includes sewing a puff cover onto the puff base, and d) charging powder in powder form into the puff using a powder inserting unit.

In one embodiment, a puff is provided, which may include a puff base, a puff cover for sealing an open portion of the puff base, and a compact powder mounted to an interior space of the puff base. The compact powder may include a compressed porous member therein.

The porous member may have a number of pores ranging between 35 ppi and 45 ppi.

The compact powder may be fabricated by compressing the porous member and the powder in powder form surrounding the porous member concurrently with pressure ranging between 15 kg/cm$^2$ and 25 kg/cm$^2$.

Advantageous Effects

According to a manufacturing method of puff in one embodiment, manufacturing cost is reduced, since it is not necessary to prepare a separate manufacturing line for puff casings.

Further, puffs manufactured by said manufacturing method are portable and easy to use, since the user does not have to carry around both the powder and the puff, but can simply apply cosmetic material by tapping only the puff on her skin such as her face.

MODE FOR CARRYING OUT THE INVENTION

Figure 1:
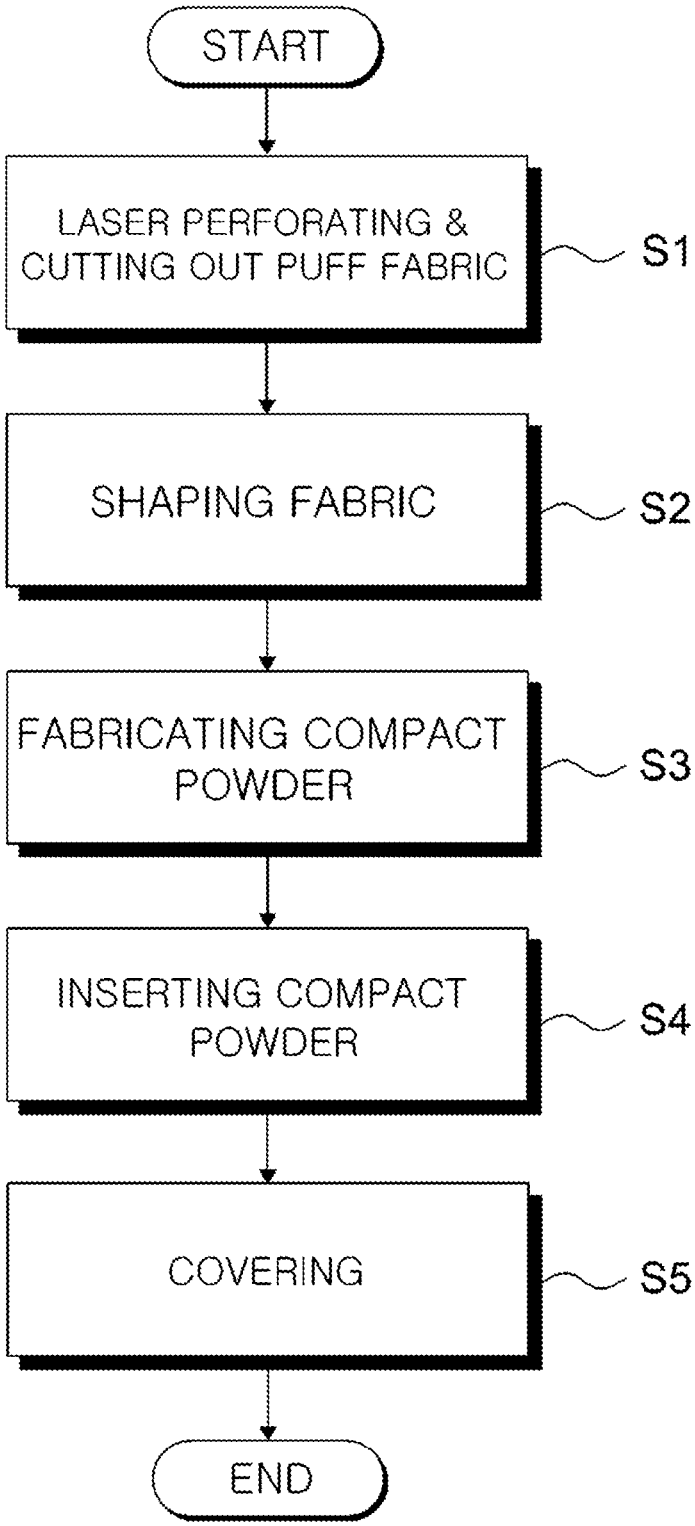
FIG. 1 is a block diagram provided to explain a method of manufacturing a puff according to an embodiment of the present invention.

Reference will now be made in detail to the embodiments of the present invention, examples of which are illustrated in the accompanying drawings, wherein like reference numerals refer to the like elements throughout. The embodiments are described below to explain the present invention by referring to the figures.

The matters defined in the description, such as detailed construction and elements, are provided to assist in a comprehensive understanding of the invention. Thus, it is apparent that the exemplary embodiments of the present invention can be carried out without those specifically defined matters. Also, well-known functions or constructions are not described in detail since they would obscure the invention with unnecessary detail.

FIG. 1 is a block diagram provided to explain a method of manufacturing a puff according to the present invention. Referring to FIG. 1, the method of manufacturing a puff according to the present invention may include steps of: laser perforating and puff fabric cutting (S1), fabric shaping (S2), compact powder fabricating (S3), compact powder inserting (S4), and covering (S5).

Figure 2:
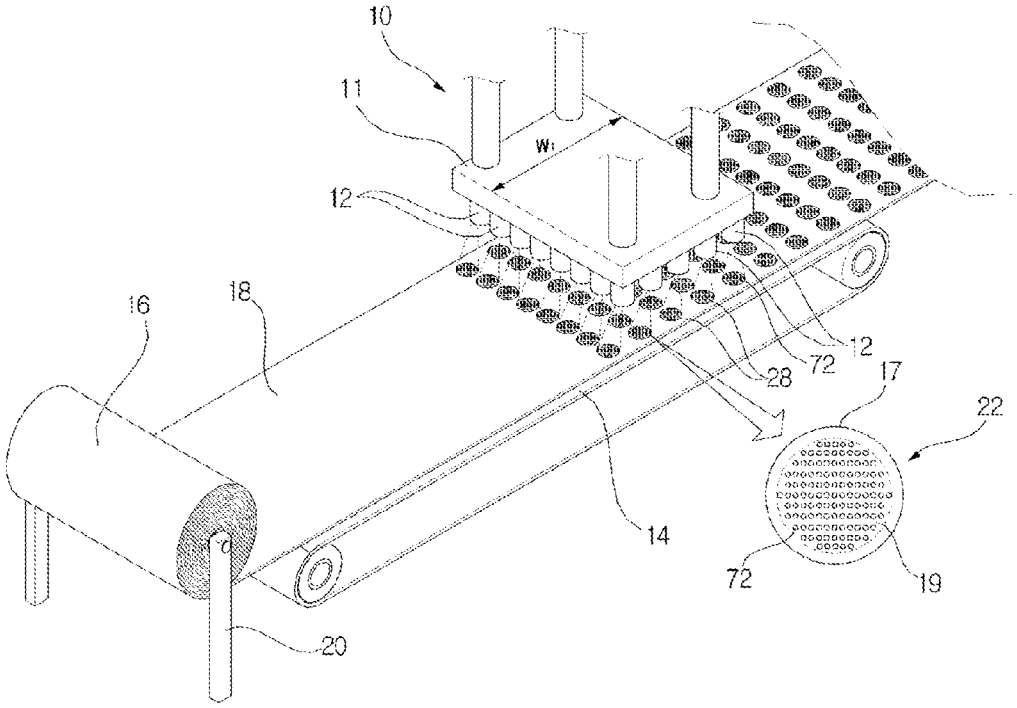
FIG. 2 is a view provided to explain a laser perforating according to the manufacturing method of FIG. 1.

The laser perforating and puff fabric cutting (S1) will be explained in detail below with reference to FIG. 2. Referring to FIG. 2, a fabric roll 16 is mounted on a fabric roll mount 20 and fabric 18 is drawn from the fabric roll 16 and conveyed through a fabric conveying means 14. A laser drill 10 having a plurality of laser units 12 is installed above the fabric conveying means 14. Laser is irradiated from the plurality of laser units 12 to cut the fabric 18 into circular shape, and without generating perforations on a peripheral area 17 of the circularly-cut fabric, the laser drills a plurality of perforations 72 only in a bottom portion 19. As a result, perforated fabric 22 is fabricated. Since the laser drill 10 has a plurality of laser units 12, a plurality of perforated fabrics 22 may be produced by only one laser irradiation. The fabric conveying means 14 intermittently conveys the fabric 18 by the width (W1) of a plate 11.

Figure 3:
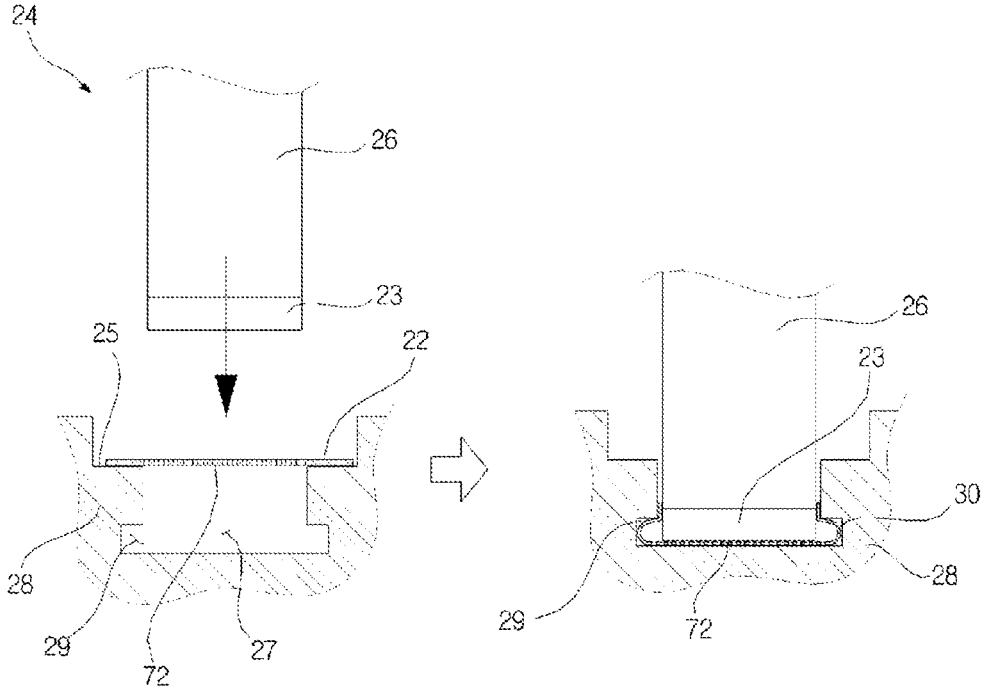
FIG. 3 is a view provided to explain fabric shaping according to the manufacturing method of FIG. 1.

Referring to FIG. 3, the perforated fabric 22 is conveyed to a puff press device 24. The puff press device 24 operates to fabricate a puff base to a semi-circular form by bending the perforated fabric 22. Referring to FIG. 3, the perforated fabric 22 is placed on a mount 25 of a puff press mold 28 and a press shaft 26 is descended. A heating portion 23 is provided at a lower end of the press shaft 26 to shape the perforated fabric 22 into hemi-circular form by applying pressure and heat thereto. Accordingly, a puff base 30 (FIG. 6) is fabricated.

Figure 4:
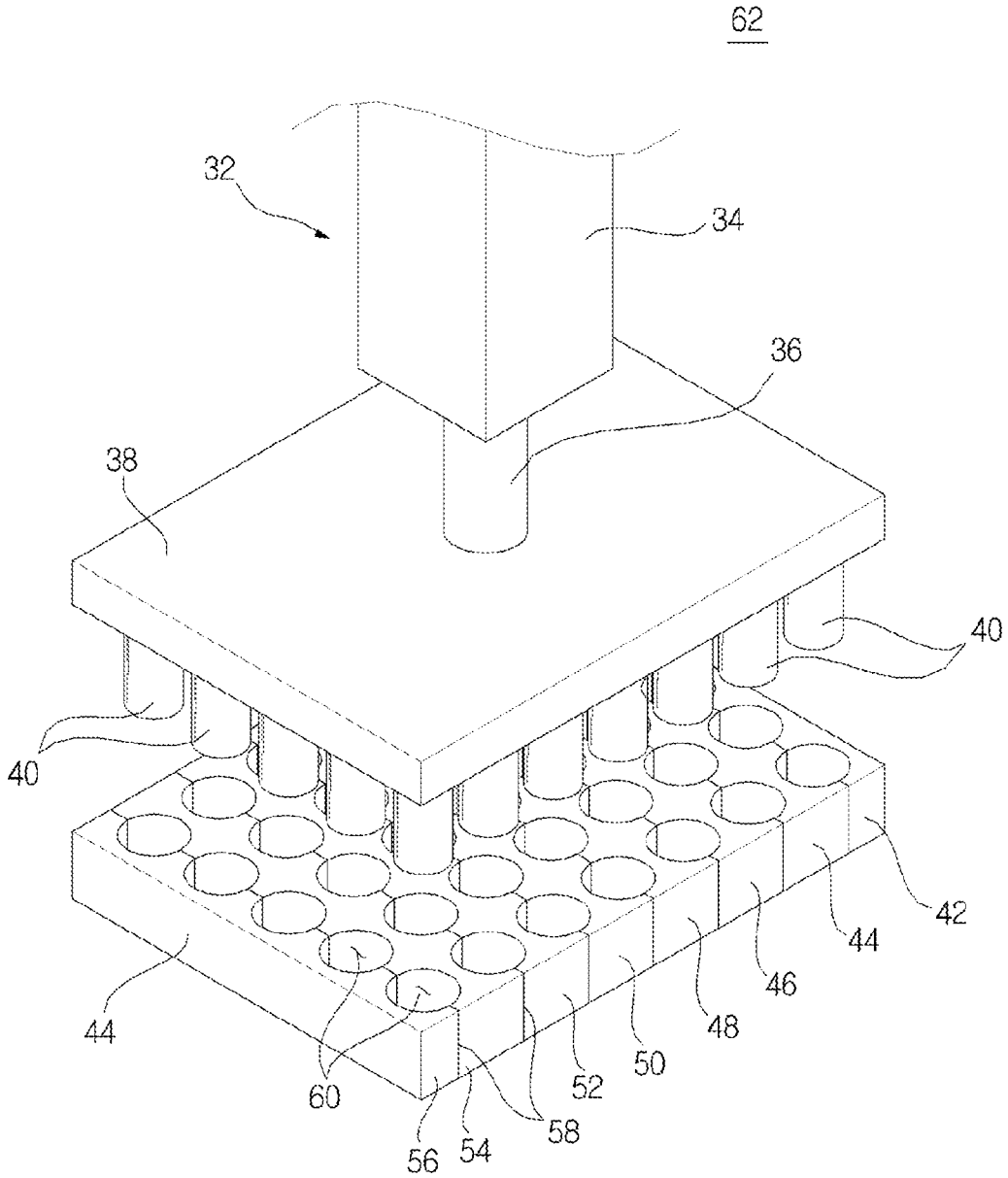
FIG. 4 is a perspective view of a compact powder manufacturing process according to the manufacturing method of FIG. 1.
Figure 5:
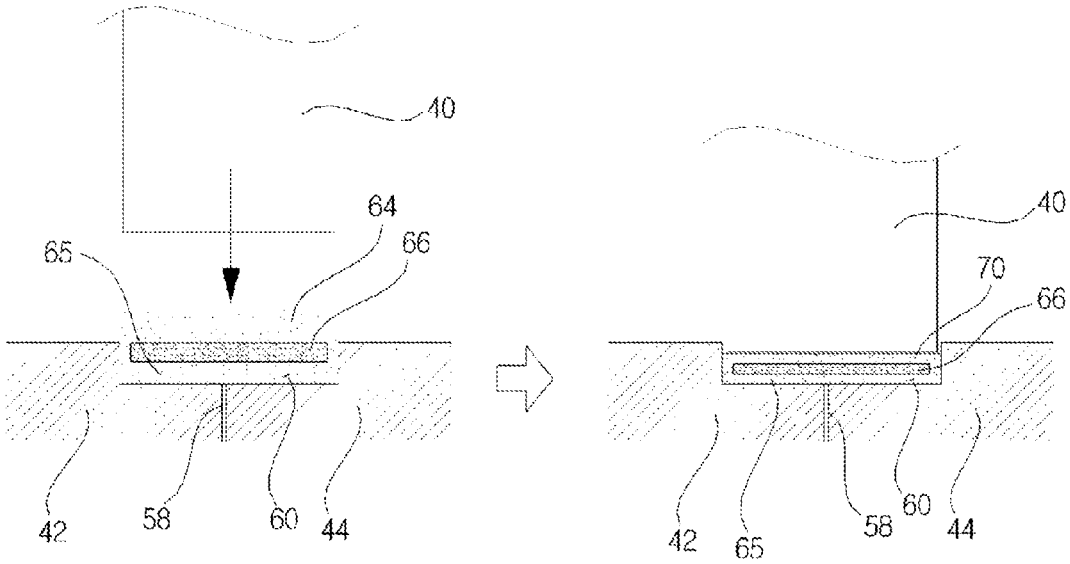
FIG. 5 is a view provided to explain a process of manufacturing compact powder according to the manufacturing method of FIG. 1.

Referring to FIGS. 4 and 5, the compact powder fabricating (S3) will be explained. FIG. 4 illustrates a compressing device 32 which produces a compact powder 70. The compressing device 32 includes a main body 34 and a cylinder shaft 36 upwardly and downwardly movable thereon, and a holder plate 38 which has a plurality of press shafts 40 and which is fixed on a lower end of the cylinder shaft 36. A mold assembly 44 is installed that the press shafts 40 are inserted into a plurality of processing spaces 60 formed thereunder.

The mold assembly 43 includes first to eighth molds 42, 44, 46, 48, 50, 52, 54, 56 which are separable from each other with reference to a separating line 58. FIG. 5 is a cross-section view of the first and second molds 42, 44. A first powder 65 in powder state is introduced into the processing spaces 60 and a porous member 66 is placed. A second powder 64 in powder state is then added to the processing spaces 60 as illustrated in the left-hand illustration of FIG. 5. The press shafts 40 are then descended to press the powders 64, 65 and the porous member 66 placed therebetween.

The inventor has confirmed after a plurality of experiments that the porous member 66 has a desired number of pores between 35 ppi and 45 ppi. Through the plurality of experiments, the applicant could confirm that although no specific problem was found in the manufacturing of the compact powder due to use of the porous member such as sponge with a number of pores below 35 ppi (e.g., 34 ppi, 33 ppi), some compact powder was found in lumps rather than in complete powder form when the fabricated puff is twisted. When the porous member with a number of pores exceeding 45 ppi is used, change in volume is so large that the internal space of the puff is increased more than necessary, and as a result, the puff is distorted to undesirable shape or becomes inconvenient to use. Given the above, it is preferable that the porous member has the number of pores between 35 ppi and 45 ppi.

Further, the powders 65 and the porous member 66 may preferably be pressed by the press shaft 40 under pressure ranging between 15 kg/cm$^2$ and 25 kg/cm$^2$. After many experiments, the inventor could confirm that, if pressed under pressure less than 15 kg/cm$^2$, the compact powder is not produced at all, or even when it is produced, naturally return to the powder form over time. If pressed under pressure exceeding 25 kg/cm$^2$, the compact powder pieces do not easily break and instead remain as they are, when the user later twists the puff to change the compact powder into powder form. Accordingly, the press shaft 40 may preferably press with the pressure in a range of 15 kg/cm$^2$ and 25 kg/cm$^2$.

When the fabrication of the puff base 30 and the compact powder 70 is finished, the compact powder inserting (S4) and the covering (S5) are performed. Accordingly, referring to FIG. 6, the compressed form of the compact powder 70 and the porous member 66 is inserted into the puff base 30 having pores 72 formed therein, and a puff cover 68 is connected to the peripheral area 17 of the puff base 30, thereby fabricating a puff 82. The covering by connecting as explained above may use sewing or adhesive.

Figure 7:
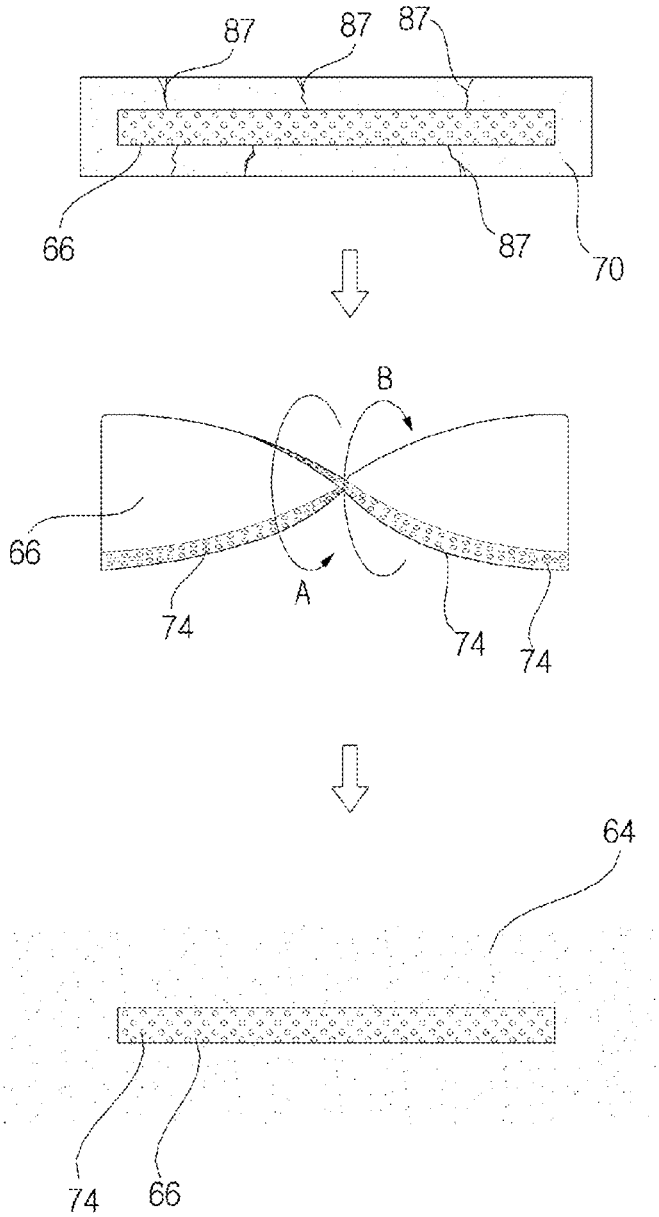
FIG. 7 is a cross-section view of a puff provided to explain a method of manufacturing a puff according to another embodiment of the present invention.

Referring to FIG. 7, a user may twist the porous member 66 to use the fabricated puff 82. That is, as the user twists the porous member 66 with the compact powder 70 squeezed therein, the compact powder 70 has cracks 87 formed therein. Air comes into the cracks. If the user goes on twisting the compact powder 70 (in arrowed direction A), the porous member 66 is distorted as illustrated in the second illustration of FIG. 7, and bloats due to the air introduced into the cracks 87. If the user ceases twisting, the porous member 66 rotates in arrowed direction B and instantly is recovered to the original shape. At this time, due to expansive force and rotational force in arrowed direction B to recover the original shape of the porous member 66, the compact powder 70 is completely changed to the powder 64 in powder form as in the third illustration of FIG. 7.

Figure 8:
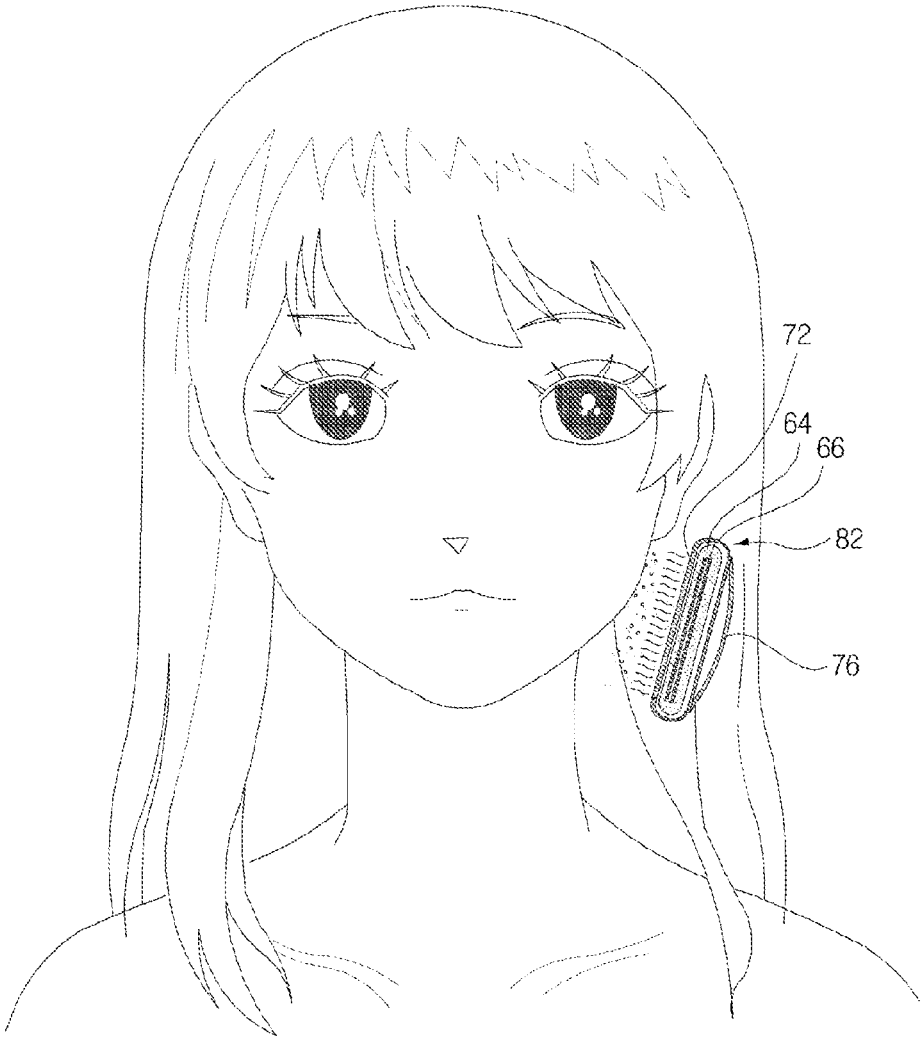
FIGS. 8 and 9 are views provided to explain use of a puff made according to the manufacturing method of FIG. 1.

Referring to FIG. 8, the powder changed into powder form 64 is subject to a force pushing outward due to the expansive pressure of the porous member 66 therein, so that the user simply has to tap the puff onto her skin to let the powder be released through the perforations 72.

Figure 6:
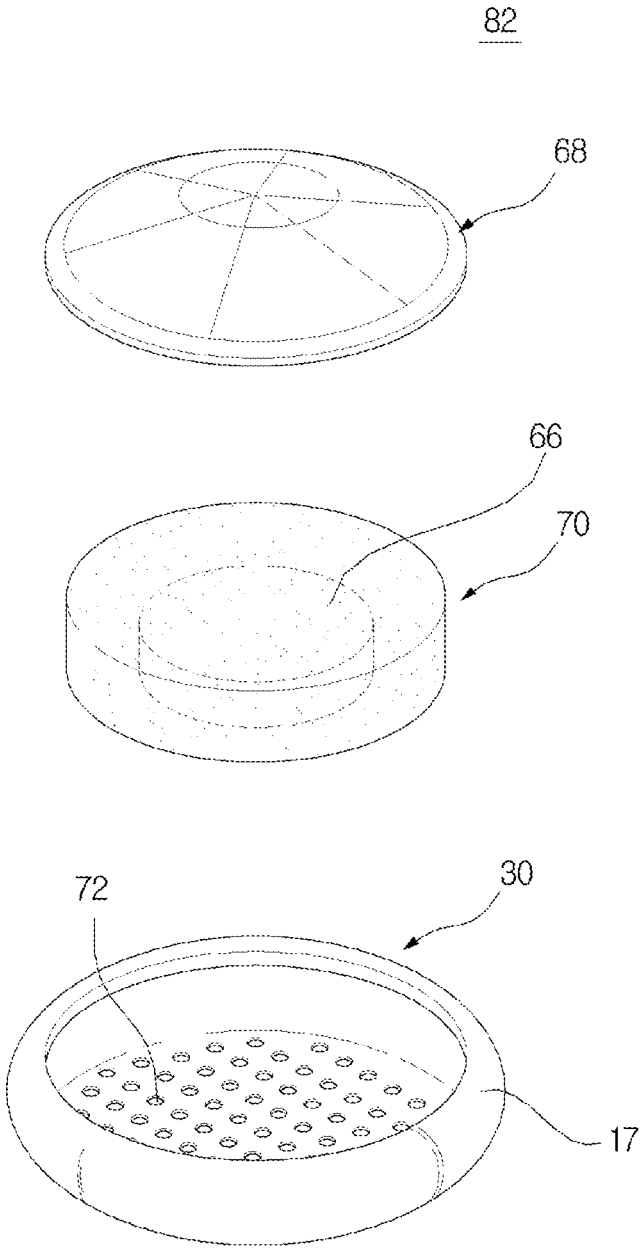
FIG. 6 is an exploded perspective view provided to explain a process of inserting and covering compact powder according to the manufacturing method of FIG. 1, and to explain puff manufactured according to the manufacturing method of FIG. 1.
Figure 9:
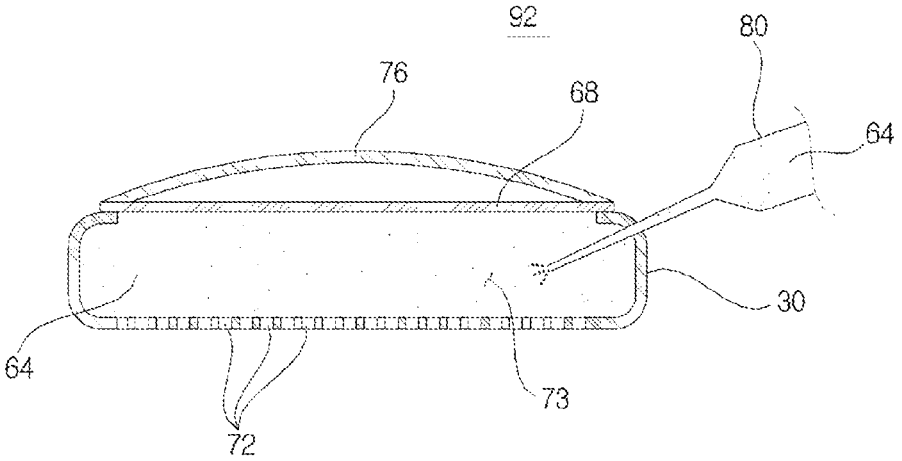

FIG. 9 is a cross section view of the puff 92 according to a second embodiment of the present invention. Referring to FIG. 9, instead of separately fabricating the compact powder, the powder 64 in powder form may be directly introduced into an internal puff space 73 using a powder inserting unit 80. That is, in one embodiment, in addition to the laser perforation and puff fabric cutting (S1), the fabric shaping (S2) and the covering (S5) as explained above, the puff with the internal space 73 may be produced, and then the powder 64 in powder form may be introduced into the internal puff space 73 using the separate powder inserting unit 80. The powder 64 in powder form may be supplemented into the internal puff space 73 after the puff is fabricated by inserting the compact powder 70 (FIG. 6).

Figure 10:
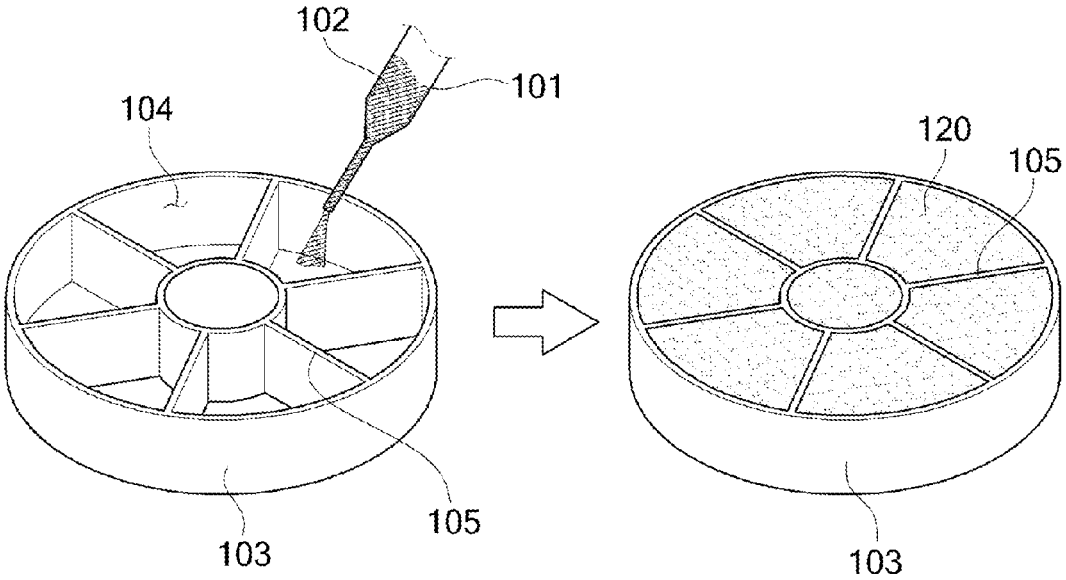
FIG. 10 is a view to illustrate fabricating compact powder according to another embodiment of the present invention.

FIG. 10 illustrates fabricating compact powder according to another embodiment. Referring to FIG. 10, powder 102 in liquid form is introduced into a powder receptacle 103 using a powder feeder 101 and left to dry over a predetermined time period. Accordingly, the powder in liquid form in the powder receptacle 103 solidifies as moisture evaporates. The powder receptacle 103 is made from silicon and includes a plurality of partitions 105 to define a plurality of empty spaces 104 to receive powder in liquid form therein.

The puff is completed as the silicon receptacle 103 containing the compact powder 120 therein is placed in the puff base 30 (FIG. 6) and sealed with a puff cover 68. Referring to FIG. 10, the silicon receptacle 103 is turned upside down so that the top portion faces the lower portion of the puff base 30 when the silicon receptacle 103 is placed in the puff base 30. The user crushes the compact powder by twisting the puff before using the puff.

While the present invention has been particularly shown and described with reference to exemplary embodiments thereof, it will be understood by those skilled in the art that various changes in form and details may be made therein without departing from the spirit and scope of the invention as defined by the appended claims.

INDUSTRIAL APPLICABILITY

The present invention is applied to a method of manufacturing a puff and a puff fabricated by the same which is portable and convenient to use in the cosmetic industry.

The invention claimed is:

1. A method of manufacturing a puff, comprising:
- a) laser perforating a puff fabric using a laser perforating device and cutting out said puff fabric to prepare a perforated fabric;
- b) fabricating a puff base by shaping the perforated fabric;
- c) preparing a compact powder containing a porous member by compressing powder in powder form with the porous member inserted therein;
- d) inserting the compact powder into the puff base; and
- e) fabricating a puff by covering the puff base which includes sewing a puff cover onto the puff base.

2. The manufacturing method of claim 1, wherein the preparing step c) comprises:
- c1) first introducing the powder in powder form into a mold;
- c2) seating the porous member on the first-introduced powder, the porous member having a number of pores ranging between 35 ppi and 45 ppi;
- c3) second introducing the powder in powder form; and c4 compressing the powder in powder form and the porous member introduced into the mold with pressure ranging between 15 kg/cm2 and 25 kg/cm2 with a compression device.

3. The manufacturing method of claim 2, further comprising:
- f) supplementally inserting the powder in powder form into an interior space of the puff.

4. The manufacturing method of claim 3, wherein the puff base is shaped in hemi-circular form by applying pressure and heat.

5. The manufacturing method of claim 2, wherein the puff base is shaped in hemi-circular form by applying pressure and heat.

6. The manufacturing method of claim 1, further comprising:
- f) supplementally inserting the powder in powder form into an interior space of the puff.

7. The manufacturing method of claim 6, wherein the puff base is shaped in hemi-circular form by applying pressure and heat.

8. The manufacturing method of claim 1, wherein the puff base is shaped in hemi-circular form by applying pressure and heat.

9. A method of manufacturing a puff, comprising:
- a) laser perforating a puff fabric using a laser perforating device and cutting out said puff fabric to prepare a perforated fabric;
- b) fabricating a puff base by shaping the perforated fabric;
- c) finishing an exterior of the puff by covering the puff base which includes sewing a puff cover onto the puff base; and
- d) filling powder in powder form into the puff using a powder inserting unit.

10. The manufacturing method of claim 9, wherein the puff base is shaped in hemi-circular form by applying pressure and heat.

11. A puff comprising:
- a puff base;
- a puff cover for sealing an open portion of the puff base; and
- a compact powder mounted to an interior space of the puff base, wherein the compact powder includes a compressed porous member therein.

12. The puff of claim 11, wherein the porous member has a number of pores ranging between 35 ppi and 45 ppi.

13. The puff of claim 12, wherein the compact powder is fabricated by compressing the porous member and the powder in powder form surrounding the porous member concurrently with pressure ranging between 15 $kg/cm^2$ and 25 $kg/cm^2$.

14. The puff of claim 13, wherein the puff base is shaped in hemi-circular form by applying pressure and heat.

15. The puff of claim 12, wherein the puff base is shaped in hemi-circular form by applying pressure and heat.

16. The puff of claim 11, wherein the compact powder is fabricated by compressing the porous member and the powder in powder form surrounding the porous member concurrently with pressure ranging between 15 $kg/cm^2$ and 25 $kg/cm^2$.

17. The puff of claim 16, wherein the puff base is shaped in hemi-circular form by applying pressure and heat.

18. The puff of claim 11, wherein the puff base is shaped in hemi-circular form by applying pressure and heat.

19. A method of manufacturing a puff, comprising:
- a) laser perforating a puff fabric using a laser perforating device and cutting out said puff fabric to prepare a perforated fabric;
- b) fabricating a puff base by shaping the perforated fabric;
- c) introducing powder in liquid form into a powder receptacle and leaving the powder in liquid form to dry, in order to fabricate a compact powder;
- d) inserting the compact powder into the puff base; and
- e) fabricating the puff by covering the puff base which includes sewing a puff cover onto the puff base.

20. A puff comprising:

a puff base;

a puff cover for sealing an open portion of the puff base; and a powder receptacle mounted to an internal space of the puff base and containing a compact powder therein, wherein the powder receptacle is made from a silicon material, and includes a plurality of partitions to define a plurality of spaces to which powder in liquid form is introduced.

* * * * *